US008040363B2

(12) United States Patent
Park et al.

(10) Patent No.: US 8,040,363 B2
(45) Date of Patent: Oct. 18, 2011

(54) ORGANIC LIGHT EMITTING DISPLAY WITH USER BRIGHTNESS CONTROL AND METHOD OF DRIVING THE SAME

(75) Inventors: Young Jong Park, Seoul (KR); Sung Cheon Park, Suwon (KR)

(73) Assignee: Samsung Mobile Display Co., Ltd., Yongin (KR)

( * ) Notice: Subject to any disclaimer, the term of this patent is extended or adjusted under 35 U.S.C. 154(b) by 1520 days.

(21) Appl. No.: 11/414,033

(22) Filed: Apr. 27, 2006

(65) Prior Publication Data

US 2006/0262109 A1 Nov. 23, 2006

(30) Foreign Application Priority Data

Apr. 28, 2005 (KR) ..... 10-2005-0035773

(51) Int. Cl.
*G09G 5/00* (2006.01)

(52) U.S. Cl. ..... 345/691

(58) Field of Classification Search ..... 345/76–77, 345/82, 204, 209, 691, 690
See application file for complete search history.

(56) References Cited

U.S. PATENT DOCUMENTS

| | | | | |
|---|---|---|---|---|
| 6,473,065 | B1 * | 10/2002 | Fan | 345/82 |
| 6,791,566 | B1 | 9/2004 | Kuratomi et al. | |
| 2003/0025718 | A1 * | 2/2003 | Mori | 345/690 |
| 2003/0222865 | A1 * | 12/2003 | Tsuchihashi | 345/209 |
| 2004/0041823 | A1 * | 3/2004 | Shin | 345/690 |
| 2004/0150592 | A1 * | 8/2004 | Mizukoshi et al. | 345/76 |
| 2005/0007319 | A1 * | 1/2005 | Shin et al. | 345/76 |
| 2005/0200617 | A1 * | 9/2005 | Kwak et al. | 345/204 |
| 2005/0242743 | A1 * | 11/2005 | Kwak | 315/160 |
| 2005/0243037 | A1 * | 11/2005 | Eom et al. | 345/76 |
| 2005/0253791 | A1 * | 11/2005 | Shin | 345/76 |
| 2006/0022964 | A1 * | 2/2006 | Kim et al. | 345/204 |

FOREIGN PATENT DOCUMENTS

JP 59-181882 A 10/1984

(Continued)

OTHER PUBLICATIONS

Japan Office Action dated Nov. 25, 2008 for corresponding Japanese Application No. 2005-340896, noting listed references in this IDS.

(Continued)

*Primary Examiner* — Quan-Zhen Wang
*Assistant Examiner* — Tony Davis
(74) *Attorney, Agent, or Firm* — Christie, Parker & Hale, LLP

(57) ABSTRACT

An organic light emitting display capable of controlling brightness responsive to a user request. The display includes a brightness controller for controlling the brightness of a display region. The brightness controller includes a first look up table for storing widths of emission control signals corresponding to the image data of one frame period and a second look up table for storing at least one outside input mode for changing the widths of the emission control signals responsive to the outside input modes. By forming virtual look up tables, it is possible to vary the outside input modes in response to a user request in order to change the brightness of the display region while saving memory. Controlling the brightness of the display region also allows reducing power consumption, preventing the eyes of a user from getting tired, and maintaining image contrast of the display region.

21 Claims, 13 Drawing Sheets

FOREIGN PATENT DOCUMENTS

| | | | |
|---|---|---|---|
| JP | 03-138691 | A | 6/1991 |
| JP | 2000-221944 | | 8/2000 |
| JP | 2001-134237 | A | 5/2001 |
| JP | 2001-290471 | A | 10/2001 |
| JP | 2003-208142 | A | 7/2003 |
| JP | 2004-138831 | | 5/2004 |
| JP | 2004-226582 | A | 8/2004 |
| JP | 2005-055726 | A | 3/2005 |
| KR | 2002-0054874 | | 7/2002 |
| KR | 10-2004-0069066 | | 8/2004 |
| WO | WO 2004/023446 | A1 | 3/2004 |

OTHER PUBLICATIONS

Patent Abstracts of Japan, Publication No. 2004-138831; Publication Date: May 13, 2004; in the name of Mizukoshi et al.

SIPO Office action, dated Jun. 13, 2008, for corresponding China Application No. 200610079982.3, with English translation, indicating relevance of listed references in this IDS.

Patent Abstracts of Japan, Publication No. 2000-221944, dated Aug. 11, 2000, in the name of Koji Ogusu et al.

Korean Patent Abstracts, Publication No. 1020020054874 A, dated Jul. 8, 2002, in the name of Jeong Taek Eo et al.

* cited by examiner

FIG. 6

420

| VALUES OF UPPER 5 BITS (CONTROL DATA) | EMISSION RATE | EMISSION RATIO | BRIGHTNESS | THE FIRST WIDTHS OF EMISSION CONTROL SIGNAL (EW1) (NUMBER OF HSYNC) |
|---|---|---|---|---|
| 0 | 0% | 100% | 300 | 325 |
| 1 | 4% | 100% | 300 | 325 |
| 2 | 7% | 100% | 300 | 325 |
| 3 | 11% | 100% | 300 | 325 |
| 4 | 14% | 100% | 300 | 325 |
| 5 | 18% | 99% | 298 | 322 |
| 6 | 22% | 98% | 295 | 320 |
| 7 | 25% | 95% | 285 | 309 |
| 8 | 29% | 92% | 275 | 298 |
| 9 | 33% | 88% | 263 | 284 |
| 10 | 36% | 83% | 250 | 271 |
| 11 | 40% | 79% | 237 | 257 |
| 12 | 43% | 75% | 224 | 243 |
| 13 | 47% | 70% | 209 | 226 |
| 14 | 51% | 64% | 193 | 209 |
| 15 | 54% | 61% | 182 | 197 |
| 16 | 58% | 57% | 170 | 184 |
| 17 | 61% | 53% | 160 | 173 |
| 18 | 65% | 50% | 150 | 163 |
| 19 | 69% | 48% | 143 | 155 |
| 20 | 72% | 45% | 136 | 147 |
| 21 | 76% | 43% | 130 | 141 |
| 22 | 79% | 41% | 124 | 134 |
| 23 | 83% | 40% | 119 | 128 |
| 24 | 87% | 38% | 113 | 122 |
| 25 | 90% | 36% | 109 | 118 |
| 26 | 94% | 35% | 104 | 113 |
| 27 | 98% | 34% | 101 | 109 |
| 28 | – | – | – | – |
| 29 | – | – | – | – |
| 30 | – | – | – | – |
| 31 | – | – | – | – |

FIG. 7A

440

| OUTSIDE INPUT MODE | CHANGE VALUE (EWd) (NUMBER OF HSYNC) |
|---|---|
| 0 (SUPER POWER SAVING MODE) | 70 |
| 1 (POWER SAVING MODE) | 40 |
| 2 (NORMAL MODE) | 10 |
| 3 (BRIGHT MODE) | 0 |

FIG. 7B

420

FIRST LOOK UP TABLE

| VALUES OF UPPER 5 BITS (CONTROL DATA) | THE FIRST WIDTHS OF EMISSION CONTROL SIGNAL (EW1) (NUMBER OF HSYNC) |
|---|---|
| 0 | 325 |
| 1 | 325 |
| 2 | 325 |
| 3 | 325 |
| 4 | 325 |
| 5 | 322 |
| 6 | 320 |
| ⋮ | ⋮ |
| 27 | 109 |
| 28 | – |
| 29 | – |
| 30 | – |
| 31 | – |

[EW2=EW1−EWd]

EWd=70 EWd=40 EWd=10

<MODE0>

| VALUES OF UPPER 5 BITS (CONTROL DATA) | THE SECOND WIDTHS OF EMISSIONCONTROL SIGNAL (EW2) (NUMBER OF HSYNC) |
|---|---|
| 0 | 255 |
| 1 | 255 |
| 2 | 255 |
| 3 | 255 |
| 4 | 255 |
| 5 | 252 |
| 6 | 250 |
| ⋮ | ⋮ |
| 27 | 39 |
| 28 | – |
| 29 | – |
| 30 | – |
| 31 | – |

<MODE1>

| VALUES OF UPPER 5 BITS (CONTROL DATA) | THE SECOND WIDTHS OF EMISSIONCONTROL SIGNAL (EW2) (NUMBER OF HSYNC) |
|---|---|
| 0 | 285 |
| 1 | 285 |
| 2 | 285 |
| 3 | 285 |
| 4 | 285 |
| 5 | 282 |
| 6 | 280 |
| ⋮ | ⋮ |
| 27 | 69 |
| 28 | – |
| 29 | – |
| 30 | – |
| 31 | – |

<MODE2>

| VALUES OF UPPER 5 BITS (CONTROL DATA) | THE SECOND WIDTHS OF EMISSIONCONTROL SIGNAL (EW2) (NUMBER OF HSYNC) |
|---|---|
| 0 | 315 |
| 1 | 315 |
| 2 | 315 |
| 3 | 315 |
| 4 | 315 |
| 5 | 312 |
| 6 | 310 |
| ⋮ | ⋮ |
| 27 | 99 |
| 28 | – |
| 29 | – |
| 30 | – |
| 31 | – |

FIG. 8A

440'

| OUTSIDE INPUT MODE | CHANGE VALUE (EWd) (RATE) |
|---|---|
| 0 (SUPER POWER SAVING MODE) | 0.5 |
| 1 (POWER SAVING MODE) | 0.7 |
| 2 (NORMAL MODE) | 0.9 |
| 3 (BRIGHT MODE) | 1 |

FIG. 8B

420

FIRST LOOK UP TABLE

| VALUES OF UPPER 5 BITS (CONTROL DATA) | THE FIRST WIDTHS OF EMISSION CONTROL SIGNAL (EW1) (NUMBER OF HSYNC) |
|---|---|
| 0 | 325 |
| 1 | 325 |
| 2 | 325 |
| 3 | 325 |
| 4 | 325 |
| 5 | 322 |
| 6 | 320 |
| ⋮ | ⋮ |
| 27 | 109 |
| 28 | — |
| 29 | — |
| 30 | — |
| 31 | — |

[EW2=EW1× EWd]

EWd=0.5 EWd=0.7 EWd=0.9

<MODE0>

| VALUES OF UPPER 5 BITS (CONTROL DATA) | THE SECOND WIDTHS OF EMISSIONCONTROL SIGNAL (EW2) (NUMBER OF HSYNC) |
|---|---|
| 0 | 163 |
| 1 | 163 |
| 2 | 163 |
| 3 | 163 |
| 4 | 163 |
| 5 | 161 |
| 6 | 160 |
| ⋮ | ⋮ |
| 27 | 55 |
| 28 | — |
| 29 | — |
| 30 | — |
| 31 | — |

<MODE1>

| VALUES OF UPPER 5 BITS (CONTROL DATA) | THE SECOND WIDTHS OF EMISSIONCONTROL SIGNAL (EW2) (NUMBER OF HSYNC) |
|---|---|
| 0 | 228 |
| 1 | 228 |
| 2 | 228 |
| 3 | 228 |
| 4 | 228 |
| 5 | 225 |
| 6 | 224 |
| ⋮ | ⋮ |
| 27 | 76 |
| 28 | — |
| 29 | — |
| 30 | — |
| 31 | — |

<MODE2>

| VALUES OF UPPER 5 BITS (CONTROL DATA) | THE SECOND WIDTHS OF EMISSIONCONTROL SIGNAL (EW2) (NUMBER OF HSYNC) |
|---|---|
| 0 | 293 |
| 1 | 293 |
| 2 | 293 |
| 3 | 293 |
| 4 | 293 |
| 5 | 290 |
| 6 | 288 |
| ⋮ | ⋮ |
| 27 | 98 |
| 28 | — |
| 29 | — |
| 30 | — |
| 31 | — |

ORGANIC LIGHT EMITTING DISPLAY WITH USER BRIGHTNESS CONTROL AND METHOD OF DRIVING THE SAME

CROSS-REFERENCE TO RELATED APPLICATION

This application claims the benefit of Korean Patent Application No. 2005-35773, filed on Apr. 28, 2005, in the Korean Intellectual Property Office, the entire content of which is incorporated herein by reference.

BACKGROUND

1. Field of the Invention

The embodiments of the present invention relate to an organic light emitting display and a method of driving the same. More specifically, the embodiments of the present invention relate to an organic light emitting display capable of reducing power consumption and memory requirements while controlling brightness in accordance with the requests of users and a method of driving this display.

2. Discussion of Related Art

Recently, various flat panel displays (FPD) having a lower weight and volume compared with cathode ray tubes (CRT) have been developed. In particular, light emitting displays having high emission efficiency, brightness, and response speed and large view angles are spotlighted.

Light emitting displays are generally divided into organic light emitting displays using organic light emitting diodes (OLED) and inorganic light emitting displays using inorganic light emitting diodes. OLEDs include anode electrodes, cathode electrodes, and an organic emission layer positioned between the anode electrodes and the cathode electrodes to emit light by the combination of electrons and holes. The inorganic light emitting diode referred to as a light emitting diode (LED), unlike the OLED, includes an emission layer formed of inorganic material such as a PN-junction semiconductor material.

FIG. 1 illustrates a conventional organic light emitting display. Referring to FIG. 1, the conventional organic light emitting display includes a display region 10, a data driver 20, and a scan driver 30.

The display region 10 includes pixels 11 each of which includes an OLED (not shown). The pixels 11 are formed in the regions partitioned by scan lines S1 to Sn and data lines D1 to Dm. The display region 10 receives power from a first power source ELVdd and a second power source ELVss from the outside. Each of the pixels 11 receives a scan signal, a data signal, the first power source ELVdd, and the second power source ELVss to display an image.

The data driver 20 generates data signals. The data signals generated by the data driver 20 are supplied to the data lines D1 to Dm in synchronization with scan signals to be transmitted to the pixels 11.

The scan driver 30 generates scan signals. The scan signals generated by the scan driver 30 are sequentially supplied to the scan lines S1 to Sn.

In the conventional organic light emitting display having the above structure, the larger the number of pixels 11 that emit light, the larger the amount of current that flows to the display region 10. In particular, the larger the number of pixels 11 that display high gray scales among the pixels 11 that emit light, the larger the amount of current that flows to the display region 10. Therefore, power consumption increases. Also, in the conventional organic light emitting display, the brightness of the light that is emitted corresponds only to data input from the outside and brightness cannot be changed responsive to the requests of users.

The above information disclosed in this Background section is only for enhancement of understanding of the background of the invention, and therefore it may contain information that does not form the prior art that is already known in this country to a person of ordinary skill in the art.

SUMMARY OF THE INVENTION

Accordingly, embodiments of the present invention provide an organic light emitting display capable of reducing power consumption and memory requirements while controlling brightness in accordance with the requests of users and a method of driving the display.

According to a first aspect of the present invention, there is provided an organic light emitting display including a data driver for supplying data signals corresponding to image data to data lines, a scan driver for sequentially supplying scan signals to scan lines and sequentially supplying emission control signals to emission control lines, a display region including one or more pixels receiving the data signals, the scan signals, and the emission control signals to display images, and a brightness controller for controlling the brightness of the display region. The brightness controller includes a first look up table in which first widths of the emission control signals corresponding to the image data of one frame period are stored and a second look up table in which change values for changing the widths of the emission control signals in accordance with outside input modes are stored.

The brightness controller may include a data summing unit for summing the image data of one frame period to generate sum data and for generating at least two digital values including the uppermost bit of the sum data as control data, a mode selector for extracting the change values corresponding to the outside input modes, a controller for extracting the first widths corresponding to the values of the control data and for generating second widths of the emission control signals using the extracted first widths and change values, and the brightness control signal generator for generating brightness control signals corresponding to the second widths to transmit the brightness control signals to the scan driver. The scan driver controls the widths of the emission control signals in response to the brightness control signals. The first widths are selected so that the brightness of the display region is reduced accordingly as the values of the control data increase. The change values have change values of the widths of the emission control signals corresponding to the outside input modes. The controller generates the second widths by adding the first widths and the change values to each other or subtracting the change values from the first widths. The change values are selected as decimal values corresponding to the outside input modes. The controller generates the second widths by multiplying the first widths by the change values.

According to another aspect of the present invention, there is provided an organic light emitting display including a data driver for supplying data signals to data lines, a brightness controller for controlling the brightness of a display region in response to image data of one frame period and outside input modes, a scan driver controlled by the brightness controller to generate emission control signals so that the brightness of the display region is controlled and to sequentially supply scan signals to scan lines, and the display region including pixels controlled by the data signals, the scan signals, and the emission control signals to generate light of predetermined brightness.

According to another aspect of the present invention, there is provided a method of driving an organic light emitting display, the method including extracting one of the first widths of emission control signals using image data of one frame period, extracting one of the change values in response to outside input modes and generating second widths using the extracted first widths and change values, generating brightness control signals having the widths of emission control signals using the second widths, and generating the emission control signals in response to the brightness control signals.

The first widths may be set so that the brightness of the display region is reduced as the values of the control data increase. The second widths are generated by adding the change values to the first widths or by subtracting the first widths from the change values. The second widths are generated by multiplying the change values by the first widths.

BRIEF DESCRIPTION OF THE DRAWINGS

FIG. 6 illustrates an embodiment of the first look up table illustrated in FIG. 5.

FIG. 7A illustrates a first embodiment of the second look up table illustrated in FIG. 5.

FIG. 7B illustrates look up tables virtually generated by the second look up table illustrated in FIG. 7A.

FIG. 8A illustrates a second embodiment of the second look up table illustrated in FIG. 5.

FIG. 8B illustrates a look up table virtually generated by the second look up table illustrated in FIG. 8A.

DETAILED DESCRIPTION

Figure 1:
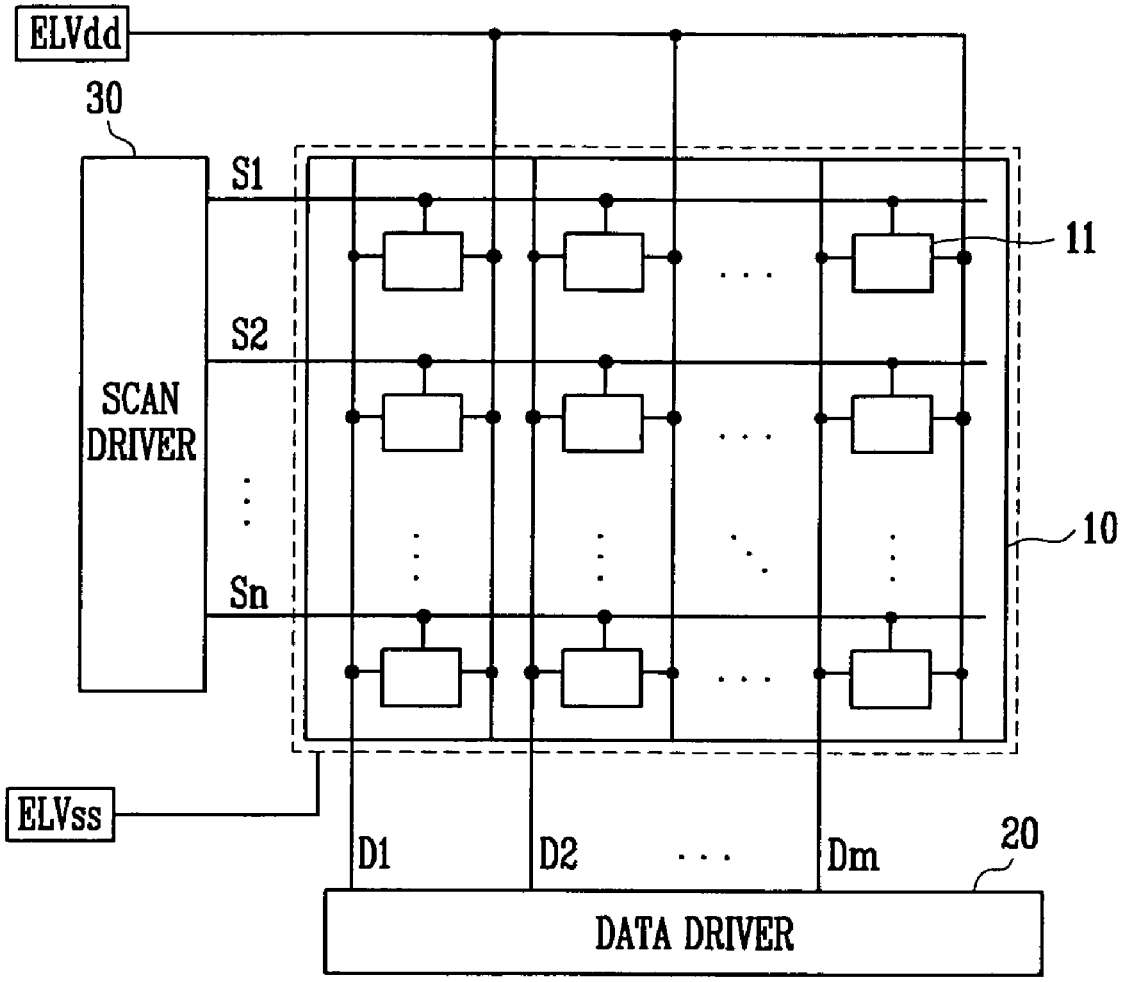
FIG. 1 (PRIOR ART)
FIG. 1 illustrates a conventional organic light emitting display.
Figure 2:
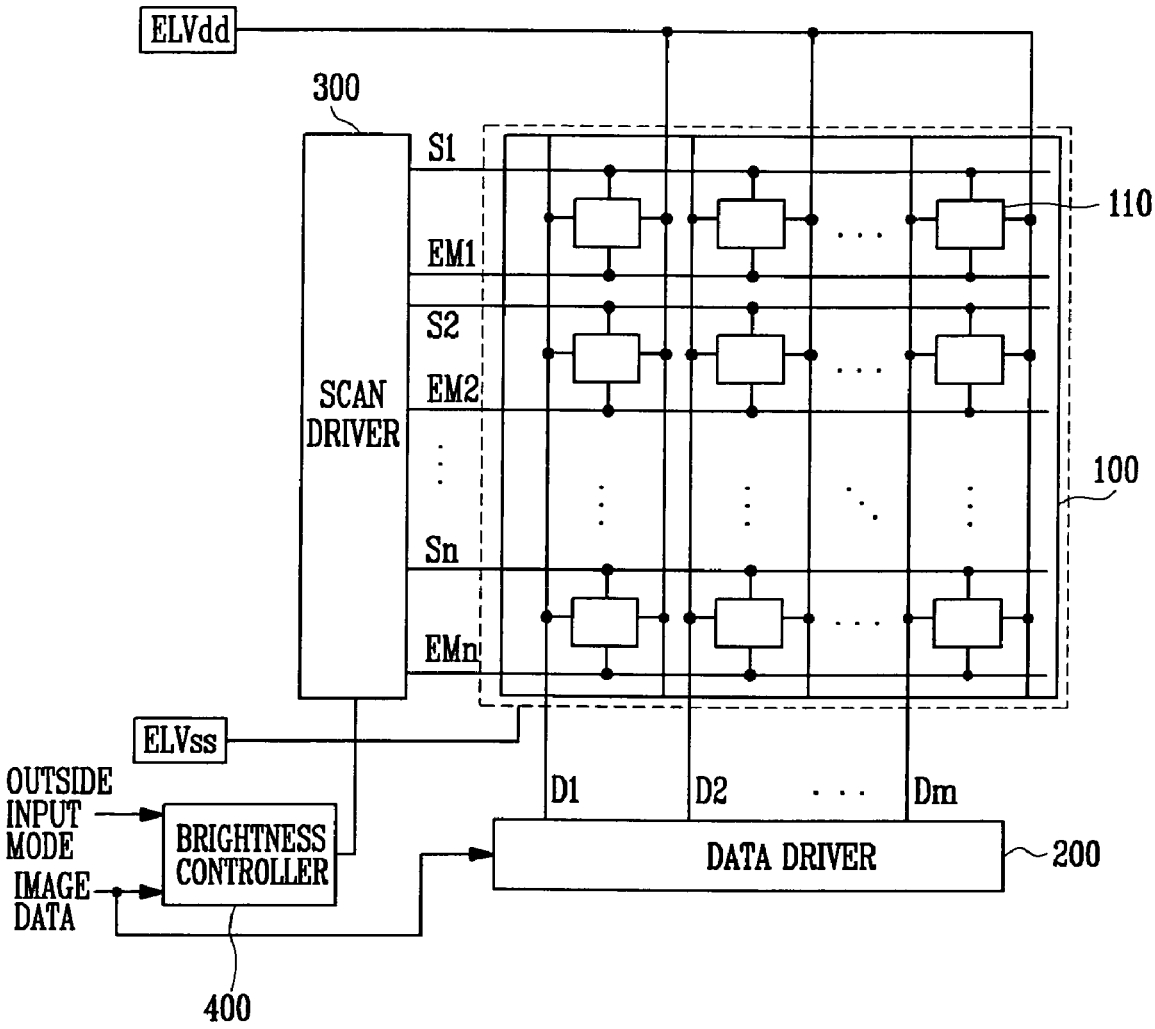
FIG. 2 illustrates an organic light emitting display according to an embodiment of the present invention.

FIG. 2 illustrates an organic light emitting display according to an embodiment of the present invention. The organic light emitting display of FIG. 2 includes a display region 100, a data driver 200, a scan driver 300, and a brightness controller 400.

The display region 100 includes pixels 110 each of which includes an OLED (not shown). The pixels 110 are formed in the regions partitioned by scan lines S1 to Sn, emission control lines EM1 to EMn, and data lines D1 to Dm. The display region 100 receives power from a first power source ELVdd and a second power source ELVss located outside the organic light emitting display. Each of the pixels 110 receives a scan signal, an emission control signal, a data signal, power from the first power source ELVdd, and power from the second power source ELVss to display an image.

The data driver 200 receives image data from the outside to generate data signals. The data signals generated by the data driver 200 are supplied to the data lines D1 to Dm in synchronization with scan signals to be transmitted to the pixels 110.

The scan driver 300 generates scan signals and emission control signals. The scan signals generated by the scan driver 300 are sequentially supplied to the scan lines S1 to Sn. The emission control signals generated by the scan driver 300 are sequentially supplied to the emission control lines EM1 to EMn. The scan driver 300 receives brightness control signals from a brightness controller 400 to generate emission control signals having widths or durations corresponding to the brightness control signals.

The brightness controller 400 generates a brightness control signal using a sum of the image data received for one frame period and a mode input by a user from the outside (hereinafter, referred to as an outside input mode). The brightness control signal generated by the brightness controller 400 is input to the scan driver 300 to control the brightness of the display region 100.

Figure 3:
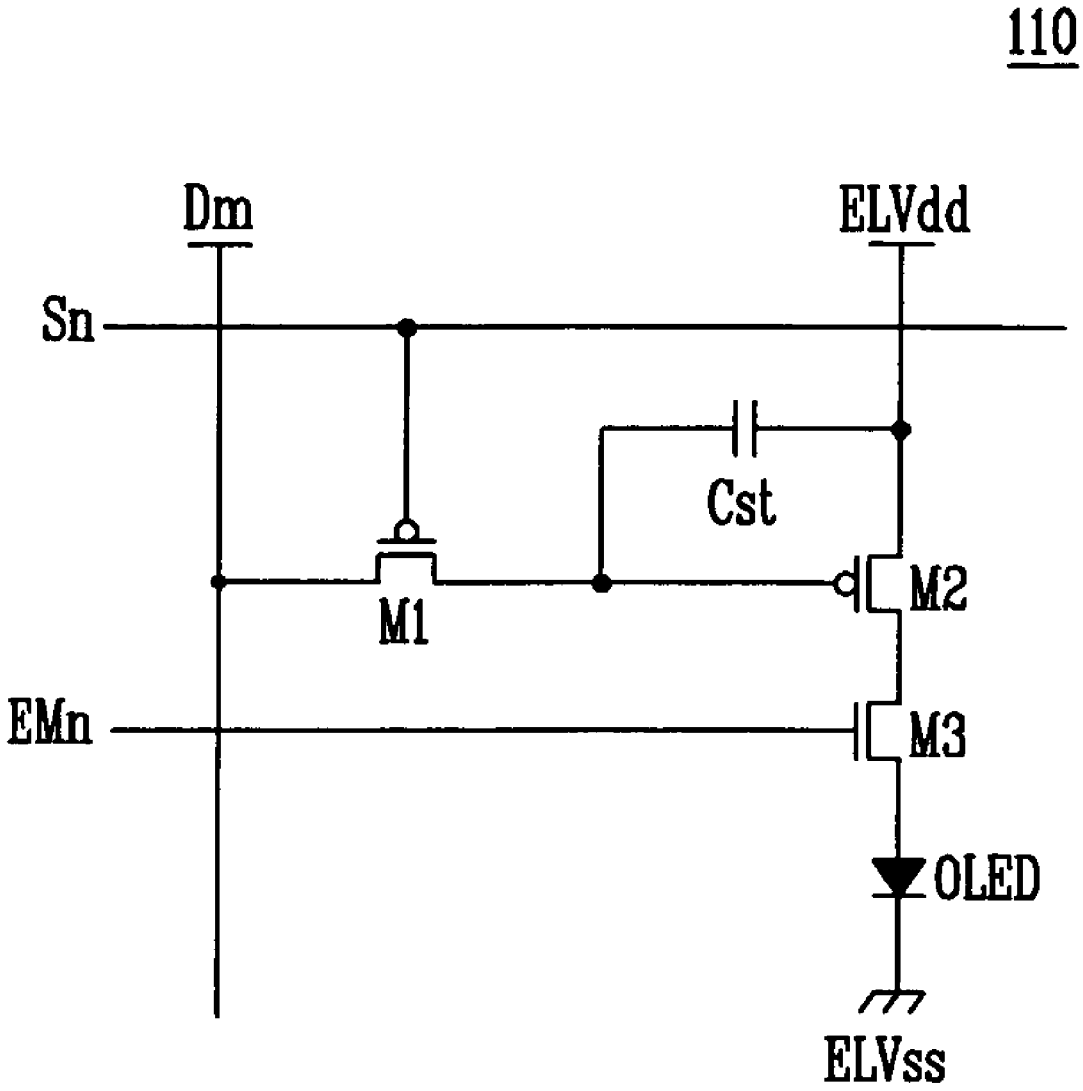
FIG. 3 illustrates an example of a pixel illustrated in FIG. 2.

FIG. 3 illustrates an example of the pixel 110 illustrated in FIG. 2. For convenience sake, in FIG. 3, the pixel 110 that is coupled to the nth scan line Sn, the nth emission control line EMn, and the mth data line Dm is illustrated.

The pixel 110 of the organic light emitting display according to the present invention includes a first transistor M1, a second transistor M2, a third transistor M3, a storage capacitor Cst, and an organic light emitting diode OLED.

A first electrode of the first transistor M1 is coupled to the data line Dm and a second electrode of the first transistor M1 is coupled to a gate electrode of the second transistor M2 and one terminal of the storage capacitor Cst. The first electrode and the second electrode may, for example, signify the source electrode and the drain electrode of the transistor, respectively. A gate electrode of the first transistor M1 is coupled to the scan line Sn. The first transistor M1 is turned on when a scan signal is supplied to the scan line Sn. The first transistor M1 supplies the data signal supplied to the data line Dm to the storage capacitor Cst. As a result, a voltage corresponding to the data signal is charged in the storage capacitor Cst.

The gate electrode of the second transistor M2 is coupled to one terminal of the storage capacitor Cst. A first electrode of the second transistor M2 is coupled to the first power source ELVdd and the other terminal of the storage capacitor Cst and a second electrode of the second transistor M2 is coupled to a second electrode of the third transistor M3. The second transistor M2 supplies a current corresponding to the voltage charged in the storage capacitor Cst from the first power source ELVdd to the second electrode of the third transistor M3.

A gate electrode of the third transistor M3 is coupled to the emission control line EMn. The second electrode of the third transistor M3 is coupled to the second electrode of the second transistor M2 and a first electrode of the third transistor M3 is coupled to an anode electrode of the OLED. In response to the emission control signal, the third transistor M3 is turned on to supply the current supplied from the second transistor M2 to the OLED. In the exemplary embodiment shown, the third transistor M3 is of a different conduction type from the first and second transistors M1, M2. For example, when the first and second transistors M1, M2 are PMOS transistors, the third transistor M3 is an NMOS transistor. Therefore, the polarity of the emission control signal that is used to turn on the NMOS third transistor M3 is opposite to the polarity of the scan signal that turns on the PMOS first and second transistors M1, M2. In alternative embodiments, the third transistor M3 may be of the same conduction type as the first and second transistors M1, M2.

Figure 4A:
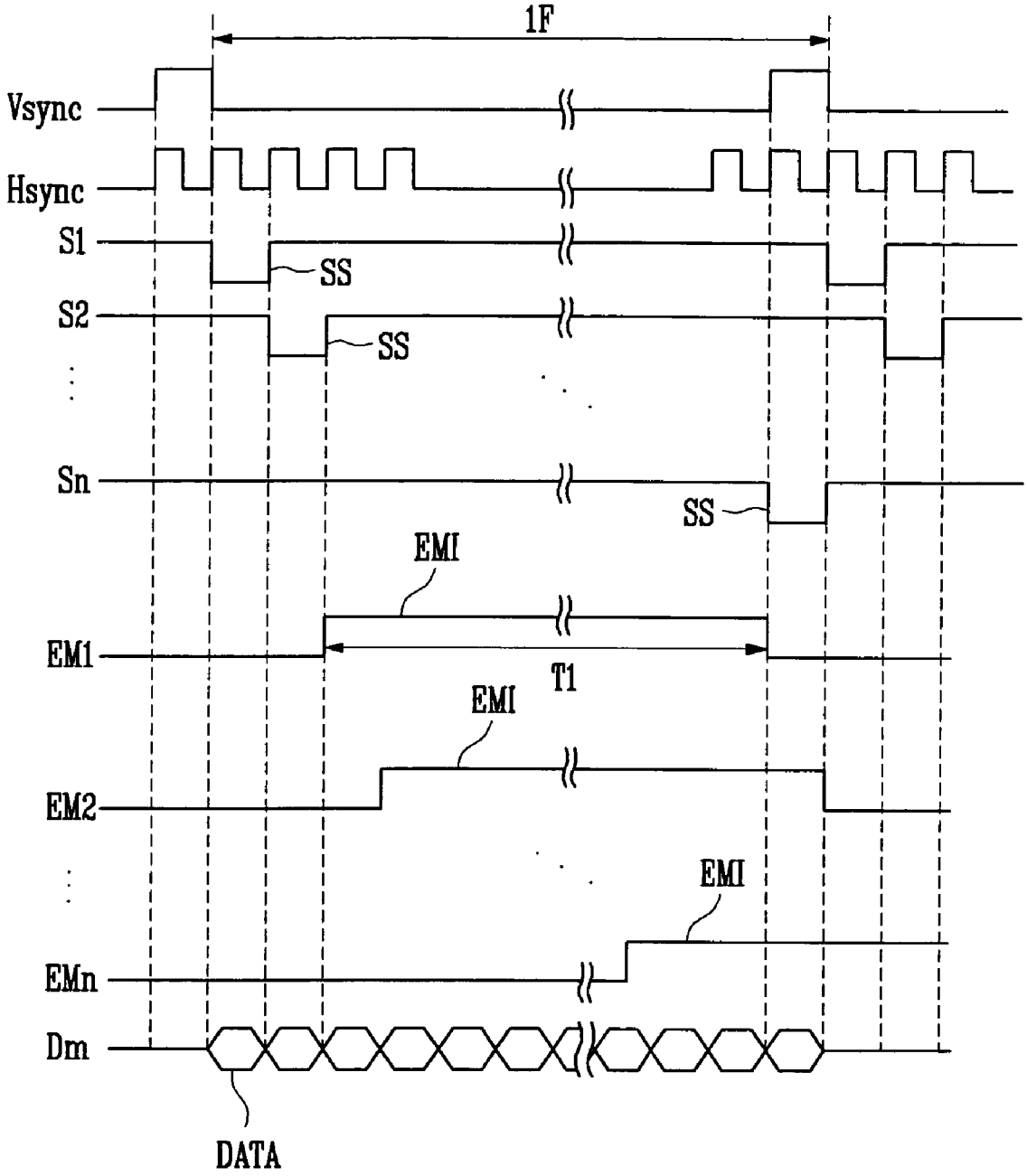
FIG. 4A illustrates waveforms that describe a method of driving the pixel illustrated in FIG. 3.
Figure 4B:
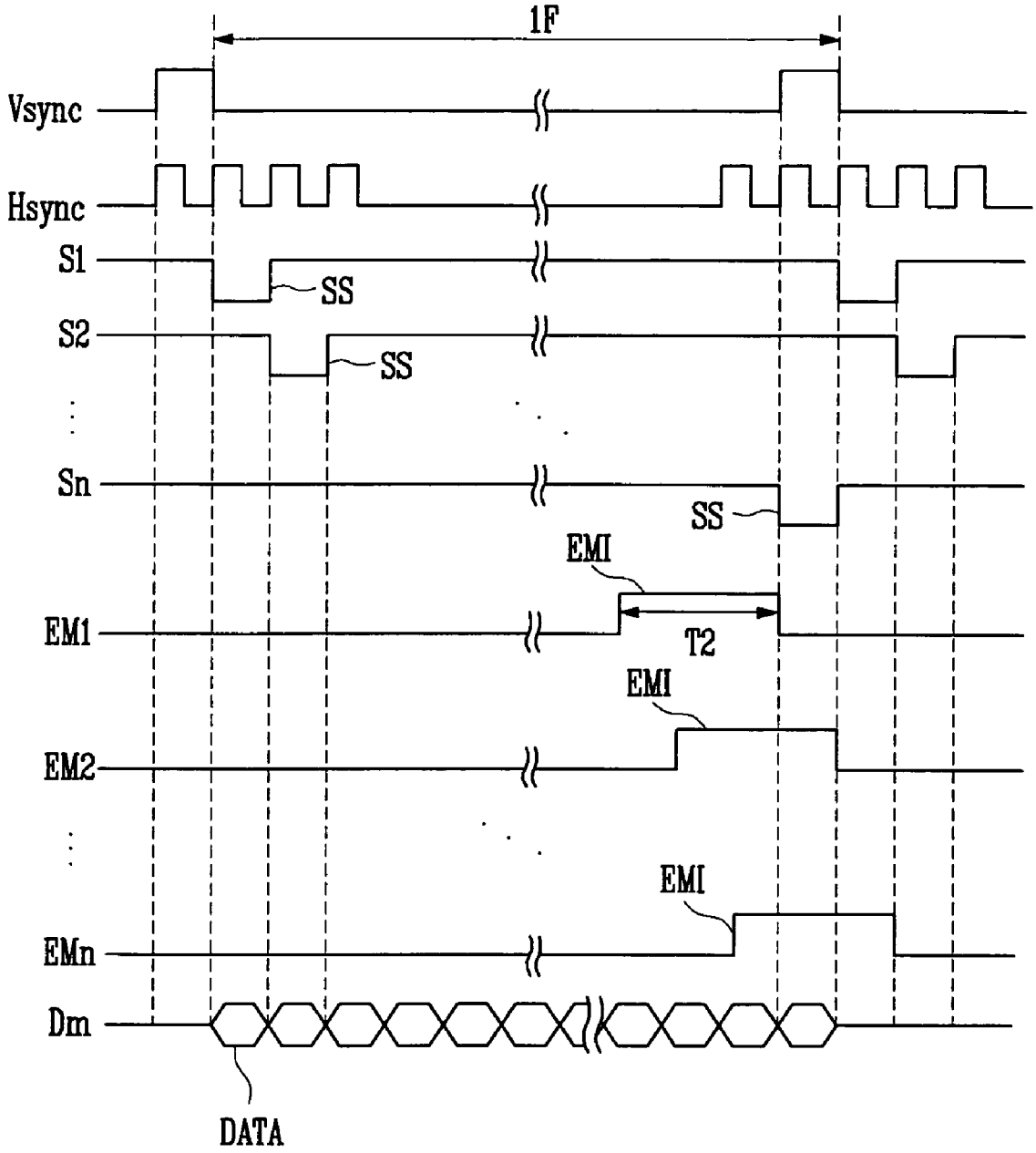
FIG. 4B illustrates waveforms that describe a method of driving the pixel illustrated in FIG. 3.

FIGS. 4A and 4B illustrate waveforms that describe a method of driving the pixel 110 illustrated in FIG. 3. The brightness controller 400 controls brightness using the widths of the emission control signals EMI. The width of a signal is the duration of the signal. The brightness controller 400 generates a sum data by summing the image data of one frame period. When the value of the sum data is small, the brightness controller 400 selects the widths of the emission control signals EMI large so that the pixels 110 emit light for a sufficient time. Conversely, when the value of the sum data is large, the brightness controller 400 selects the widths of the emission control signals EMI small so that the brightness of the pixels 110 can be limited. The brightness controller 400 selects the widths of the emission control signals EMI large, also, when a user inputs an input mode not to limit the brightness of the display region 100 and selects the widths of the emission control signals EMI small, also, when the user inputs an input mode to limit the brightness of the display region 100. Because in the pixel 110 illustrated in FIG. 3, the third transistor M3 that is turned on by the emission control signals EMI is an n-type transistor, when the widths of the emission control signals EMI are large, the emission period of the OLED during one frame period 1F becomes longer. Therefore, when the widths of the emission control signals EMI are large, a larger amount of current flows to the OLED during one frame period 1F causing the pixel 110 to emit light for a longer time. When the value of the sum data is small or the user inputs the input mode not to limit the brightness of the display region 100, the widths of the emission control signals EMI are selected equal to a first period T1 as illustrated in FIG. 4A. During the first period T1 where the emission control signals EMI are supplied, the third transistor M3 is turned on so that a predetermined current is supplied from the second transistor M2 to the OLED. Therefore, the OLED emits light during the first period T1.

When the value of the sum data is large or the user inputs the input mode to limit the brightness of the display region 100, the brightness controller 400 selects the widths of the emission control signals EMI equal to a second period T2 smaller than the first period T1 as illustrated in FIG. 4B so that the brightness of the pixels 110 is limited. During the second period T2 when the emission control signals EMI are supplied, the third transistor M3 is turned on so that a predetermined current is supplied from the second transistor M2 to the OLED. Therefore, the OLED emits light. In the case of the second period T2, because the widths of the emission control signals EMI are smaller than those of the first period T1, the portion of one frame period 1F during which the OLED emits light is reduced. Therefore, a smaller amount of current flows to the OLED and the brightness of the display region 100 is limited to a predetermined value. The scan signals SS and the emission control signals EM are generated by the scan driver 300 and the data signals DATA are generated by the data driver 200 in response to a vertical synchronizing signal Vsync and a horizontal synchronizing signal Hsync.

Figure 5:
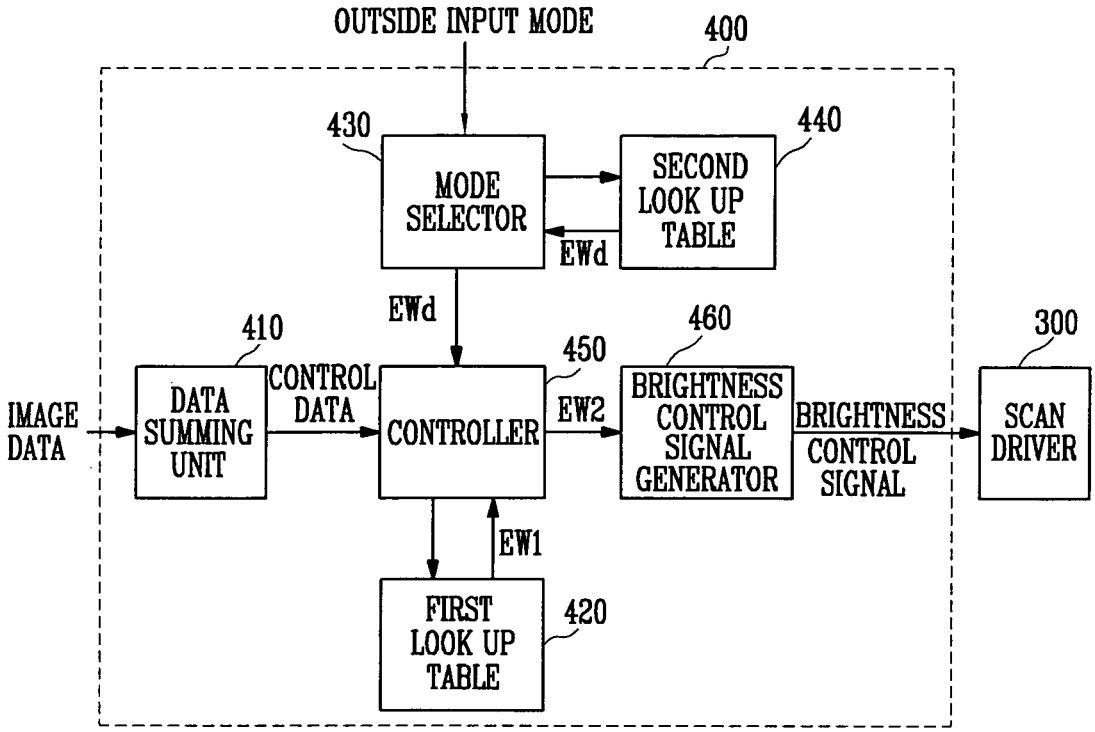
FIG. 5 illustrates an embodiment of the brightness controller illustrated in FIG. 2.

FIG. 5 illustrates an exemplary embodiment of the brightness controller 400 illustrated in FIG. 2. The brightness controller 400 includes a data summing unit 410, a first look up table 420, a mode selector 430, a second look up table 440, a controller 450, and a brightness control signal generator 460.

The data summing unit 410 sums the image data input for one frame period 1F to generate the sum data. The data summing unit 410 transmits at least two digital values (hereinafter, referred to as control data) including the uppermost bits, or the two most significant bits, of the sum data to the controller 450. In one exemplary embodiment, the values of the upper 5 bits of the sum data are transmitted. That is, the control data include the values of 5 bits. When the value of the sum data is large, it means that a large number of image data having brightness values no less than a predetermined brightness are included. When the value of the sum data is small, it means that a small number of image data having brightness values no less than the predetermined brightness are included.

The first look up table 420 stores the first widths EW1 (first data) of the emission control signal corresponding to the values of the control data. The first widths EW1 of the emission control signal are widths of the emission control signals EMI that control the emission times of the pixels 110. The first widths EW1 of the emission control signal stored in the first look up table 420 are selected so that the brightness of the display region 100 is reduced as the values of the control data increase.

The mode selector 430 extracts change values EWd (second data) from the second look up table 440 in accordance with an outside input mode input by a user to transmit the change values EWd to the controller 450.

The second look up table 440 stores at least one change value EWd that includes the change data on the widths of the emission control signals EMI in accordance with the outside input mode. The outside input mode values stored in the second look up table 440 are selected to control the brightness of the display region 100 in accordance with the requests of users.

The controller 450 extracts the first widths EW1 of the emission control signal from the first look up table 420 using the control data received from the data summing unit 410. The controller 450 receives the change values EWd from the mode selector 430. The controller 450 generates the second widths EW2 (third data) of an emission control signal using the first widths EW1 of the emission control signal and the change values EWd. The second widths EW2 of the emission control signal are obtained by modifying the first widths EW1 of the emission control signal by the change values EWd and are signal widths of the emission control signals EMI generated by the scan driver 300.

The controller 450 subtracts the change values EWd from the first widths EW1 of the emission control signal to generate the second widths EW2 of the emission control signal. As a result, the second widths EW2 of the emission control signal will be smaller as the first widths EW1 of the emission control signal get smaller and as the change values EWd get larger. The predetermined widths by which the emission control signals EMI are to be reduced are stored in the second look up table 440 as the change values EWd. On the other hand, when the brightness of the display region 100 is to be increased in accordance with the outside input mode, the controller 450 adds the first widths EW1 of the emission control signal and the change values EWd to each other to generate the second widths EW2 of the emission control signal. In this case, the second widths EW2 of the emission control signals are selected to be larger than the first widths EW1 by the amount of the change values EWd.

In another embodiment, the controller 450 multiplies the first widths EW1 of the emission control signal by the change values EWd to generate the second widths EW2 of the emission control signal. In this embodiment, the change values EWd stored in the second look up table 440 are decimal values that are the ratios of the second widths EW2 of the emission control signal to be generated to the first widths EW1 of the emission control signal. When the brightness of the display region 100 is to be increased, the change values EWd are larger than 1. When the brightness of the display region 100 is to be limited, the change values EWd are decimal values no more than 1. When the change values EWd are decimal values no more than 1, the second widths EW2 of the emission control signal will be smaller as the first widths EW1 of the emission control signal become smaller and as the change values EWd become smaller. The second widths EW2 of the emission control signal generated by the controller 450 are transmitted to the brightness control signal generator 460.

The brightness control signal generator 460 generates brightness control signals corresponding to the second widths EW2 of the emission control signal received from the controller 450. The brightness control signals generated by the brightness control signal generator 460 are input to the scan driver 300. The scan driver 300 that receives the brightness control signals generates the emission control signals EMI having widths determined by the brightness control signals.

FIG. 6 illustrates an embodiment of the first look up table 420 illustrated in FIG. 5. The contents stored in the first look up table 420 may vary according to the resolution and size of the display region 100.

The first widths EW1 of the emission control signal corresponding to the values of the upper 5 bits of the sum data, that form the control data, are stored in the first look up table 420. The first widths EW1 of the emission control signal become smaller as the values of the control data get larger so that the brightness and the resulting power consumption can be limited within a certain range. When the control data have at least one value including a minimum value, the first widths EW1 of the emission control signal are maintained uniform. The control data have a value including the minimum value when the values of the upper 5 bits of the sum data are limited to 0, 1, 2, 3, 4, or 5. In other words, when the upper 5 bits of the sum data are "00000", "00001", "00010", "00011", or "00100"then the control data have a value including the minimum value.

When the control data have a value no more than 4 (less than or equal to 4), the first widths EW1 of the emission control signal amount to 325 periods of the horizontal synchronizing signal Hsync and brightness is not limited. In the case where the control data have at least one value including the minimum value as described above, then the first widths EW1 of the emission control signal are not limited and contrast does not deteriorate when dark images are displayed. Therefore, it is possible to display images with a desirable contrast using a low value for the control data.

When the control data have values no less than 5 (greater than or equal to 5), the first widths EW1 of the emission control signal are gradually reduced as the values of the control data increase. In the case where the control data have at least one value larger than the minimum value of 4, the first widths EW1 of the emission control signal are reduced and the brightness is reduced so that it is possible to maintain power consumption within a certain range. Limiting the brightness of the display region 100 makes it possible to prevent the eyes of a user from getting tired when the user watches a screen for a long time. Because the values of the control data increase as the number of pixels that display high gray scales increases, the ratio of limiting the brightness increases.

In order to prevent the brightness from being excessively limited, the maximum ratio for limiting the brightness is selected as 34% so that the brightness is no less than 34% of maximum brightness even when the pixels 110 that display high gray scales occupy most of the area of the display region 100. That is, when at least one value of the control data is the maximum value, the first widths EW1 of the emission control signal are no less than a predetermined width. The look up table 420 in this case may be applied to moving images. The range at which the brightness is limited when the images displayed by the organic light emitting display are moving images is different from the range at which the brightness is limited when the images displayed by the organic light emitting display are still images. For example, in the case of the still images, the maximum ratio of limiting the brightness may be 50%.

FIG. 7A illustrates a first embodiment of the second look up table 440 illustrated in FIG. 5. The contents stored in the second look up table 440 may vary in accordance with the resolution and size of the display region 100.

The second look up table 440 stores the change values EWd corresponding to the outside input mode values received from the mode selector 430. The change values EWd are the degree to which the widths of the emission control signals EMI are to be reduced. The second widths EW2 of the emission control signal are generated by subtracting the change values EWd from the first widths EW1 of the emission control signal. At least two outside input modes may be set and four outside input modes are selected for convenience sake according to the first embodiment of the present invention. For example, the outside input mode in which the brightness of the display region 100 is maximally limited is referred to as a super power saving mode and is selected as 0. The change value EWd when the outside input mode is 0 is selected as the value corresponding to the 70 periods of the horizontal synchronizing signal Hsync. The outside input mode 1 is referred to as a power saving mode and the change value EWd is selected as the value corresponding to the 40 periods of the horizontal synchronizing signal Hsync. The outside input mode 2 is referred to as a normal mode and the change value EWd is selected as the value corresponding to the 10 periods of the horizontal synchronizing signal Hsync. Finally, the outside input mode 3 is referred to as a bright mode and the change value EWd is selected as 0. As described above, the change values are reduced as the outside input mode values increase. Because the change value EWd is 0 when the outside input mode value is 3, that is the maximum value among the four outside input mode values, the brightness of the display region 100 is not limited. When the outside input mode is 3, the second widths EW2 of the emission control signal are selected to be equal to the first widths EW1 of the emission control signal. In such a case, the first widths EW1 of the emission control signal are not reduced and the contrast of the display region 100 is maintained. With outside input mode 3, or bright mode, it is possible to display images with a desirable contrast.

When the outside input modes are no more than 2, the second widths EW2 of the emission control signal are reduced from the first widths EW1 of the emission control signal by the change values EWd so that the brightness of the display region 100 is limited. For example, when the outside input mode is 2, the number of periods of the horizontal synchronizing signal Hsync for the second widths EW2 of the emission control signal has 10 periods fewer than the horizontal synchronizing signal Hsync corresponding to the first widths EW1 of the emission control signal. When the second widths EW2 of the emission control signal are smaller than the first widths EW1 of the emission control signal as described above, the widths of the emission control signals EMI generated by the scan driver 300 are selected to be smaller. Therefore, the brightness of the display region 100 is reduced so that it is possible to maintain power consumption in a certain range and to prevent the eyes of a user from getting tired. Also, according to the present invention, the outside input modes are at least two and may vary so as to satisfy the requests of users. When the number of outside input modes stored in the second look up table increases, as illustrated in FIG. 7B, virtual look up tables corresponding to the number of outside input modes are generated. Therefore, a plurality of virtual look up tables are generated using one first look up table 420 so that it is possible to variably set the brightness of the display region 100. The virtual look up tables make it possible to save memory used for the look up table.

FIG. 7B illustrates look up tables virtually generated by the second look up table illustrated in FIG. 7A.

When four outside input modes 0 to 3 are selected, three. virtual look up tables are generated corresponding to outside input modes 0, 1, and 2 <Mode0>, <Mode1>, <Mode2>. As explained before, the second widths EW2 of the emission control signal are generated by subtracting the change values EWd from the first widths EW1 of the emission control signal. Therefore, in the case of the outside input mode 3 where the change value EWd is 0, the second widths EW2 of the emission control signal in accordance with the control data are selected to be equal to the first widths EW1 of the emission control signal. The look up table corresponding to outside input mode 3 is the same as the first look up table corresponding to outside input mode 0 <Mode0>.

In the cases of the outside input modes 0, 1, and 2 <Mode0>, <Mode1>, <Mode2>, the virtual look up tables in which the second widths EW2 of the emission control signal obtained by subtracting the change values EWd from the first widths EW1 of the emission control signal are stored are generated according to the respective modes. In FIG. 7B, in order to show that the look up tables are virtual, the three virtual look up tables are dot-lined. In this case, the display region 100 has four brightness reduction curves. Although the brightness reduction curves corresponding to all the outside input modes are not included, a plurality of brightness reduction curves corresponding to the number of outside input modes are generated based on the brightness reduction curve generated by the first look up table. Therefore, it is possible to satisfy various requests of users while saving memory.

FIG. 8A illustrates a second embodiment 440' of the second look up table 440 illustrated in FIG. 5. The contents stored in the second look up table 440' may vary according to the resolution and size of the display region 100.

The second look up table 440' stores the change values EWd corresponding to the outside input modes received from the mode selector 430. The change values EWd are the ratios of the second widths EW2 of the emission control signal with respect to the first widths EW1 of the emission control signal. The second widths EW2 of the emission control signal generated by the controller 450 are obtained by multiplying the first widths EW1 of the emission control signal by the change values EWd shown in FIG. 8A. The change values EWd are greater than 1 when the brightness of the display region 100 is to be increased and are decimal values no more than 1 when the brightness of the display region 100 is to be limited. According to the exemplary embodiment shown, the change values EWd are selected as the decimal values no more than 1 to limit the brightness of the display region 100. As the change values EWd become smaller, the second widths EW2 of the emission control signal also become smaller.

For convenience sake, the second embodiment is selected to include four outside input modes. For example, the outside input mode in which the brightness of the display region 100 is maximally limited is referred to as a super power saving mode and is selected as 0. The change value EWd for the outside input mode 0 is selected as 0.5. The outside input mode 1 is referred to as a power saving mode and its change value EWd is selected as 0.7. The outside input mode 2 is referred to as a normal mode and its change value EWd is selected as 0.9. Finally, the outside input mode 3 is referred to as a bright mode and its change value EWd is selected as 1. As the outside input mode values increase, the change values EWd also increase. Because the change value EWd is 1 when the outside input mode is 3, which is the maximum value among the four outside input mode values, the brightness of the display region 100 is not limited with outside input mode 3. When the outside input mode is 3, the second widths EW2 of the emission control signal are selected to be equal to the first widths EW1 of the emission control signal. In such a case, the first widths EW1 of the emission control signal are not reduced and the contrast of the display region 100 does not deteriorate. Therefore, it is possible to display images with desirable contrast.

When the outside input modes are no more than 2, the second widths EW2 of the emission control signal are obtained by multiplying the first widths EW1 of the emission control signal by the change values EWd smaller than 1 so that the brightness of the display region 100 is limited. For example, when the outside input mode is 2, the second widths EW2 of the emission control signal are obtained by multiplying the first widths EWI of the emission control signal by 0.9. When the second widths EW2 of the emission control signal are smaller than the first widths EW1 of the emission control signal, the widths of the emission control signals EM1 generated by the scan driver 300 are selected to be small. Therefore, the brightness of the display region 100 is reduced so that it is possible to maintain power consumption in a certain range and to prevent tiring the eyes of a user. Also, according to the present invention, the outside input modes are at least two and may be set to a different value in order to satisfy the requests of users. When the number of outside input modes stored in the second look up table increases, as illustrated in FIG. 8B, virtual look up tables are generated to correspond to the number of outside input modes. Therefore, a plurality of virtual look up tables are generated using the first look up table 420 so that it is possible to vary the brightness of the display region 100. Therefore, it is possible to save the memory used for the look up table.

FIG. 8B illustrates look up tables virtually generated by the second look up table 440' illustrated in FIG. 8A.

When four outside input modes 0, 1, 2, and 3 are selected, three virtual look up tables are generated <Mode0>, <Mode1>, <Mode2>. Because the second widths EW2 of the emission control signal are generated by multiplying the first widths EW1 of the emission control signal by the change values EWd, in the case of the outside input mode 3 where the change value EWd is 1, the second widths EW2 of the emission control signal in accordance with the control data are selected to be equal to the first widths EW1 of the emission control signal. Then, the look up table for this outside input mode is the same as the first look up table. For the outside input modes 0, 1, and 2, the virtual look up tables, in which the second widths EW2 of the emission control signal generated by multiplying the first widths EW1 of the emission control signal by the change values EWd are stored, are generated in accordance with the respective outside input modes. In this case, the display region 100 has four brightness reduction curves. While not all the lookup tables are shown, a plurality of brightness reduction curves corresponding to the number of outside input modes are generated based on the brightness reduction curve generated by the first look up table. Therefore, it is possible to satisfy various requests of users while saving memory.

Figure 9:
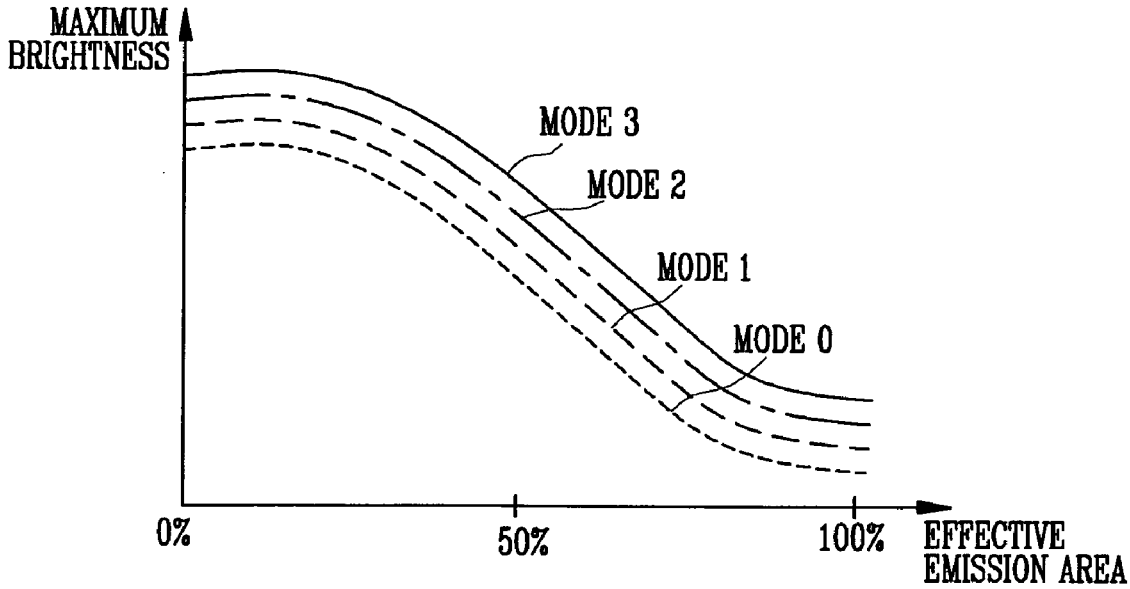
FIG. 9 is a graph illustrating brightness reduction curves in accordance with the look up tables illustrated in FIGS. 7A and 8A.

FIG. 9 is a graph illustrating brightness reduction curves in accordance with the second look up tables 440, 440' illustrated in FIGS. 7A and 8A.

The maximum brightness of the display region 100 is reduced as the effective emission areas increase in the corresponding outside input modes. The effective emission areas are the areas of the pixels 110 that emit light with brightness no less than predetermined brightness. In outside input mode 3 where the brightness of the display region 100 is selected to be large, the brightness of the display region 100 is limited by the emission control signals EMI whose widths are equal to the first widths EW1 of the emission control signal. Because the effective emission areas increase as the values of the control data increase, the ratio of limiting the brightness of the display region 100 increases. In outside input modes 0, 1, and 2, the brightness is more limited than outside input mode 3 by a predetermined value. As a result, the brightness reduction curves for these outside input modes are below the curve of the outside input mode 3 by the same predetermined value. That is, according to embodiments of the present invention, the first widths EW1 of the emission control signal corresponding to the different outside input modes are changed with respect to the first width EW1 corresponding to the outside input mode 3, in order to generate the plurality of brightness reduction curves corresponding to the outside input modes 0, 1, and 2. As described above, the display region 100 has different brightness reduction curves corresponding to at least two outside input modes.

Figure 10:
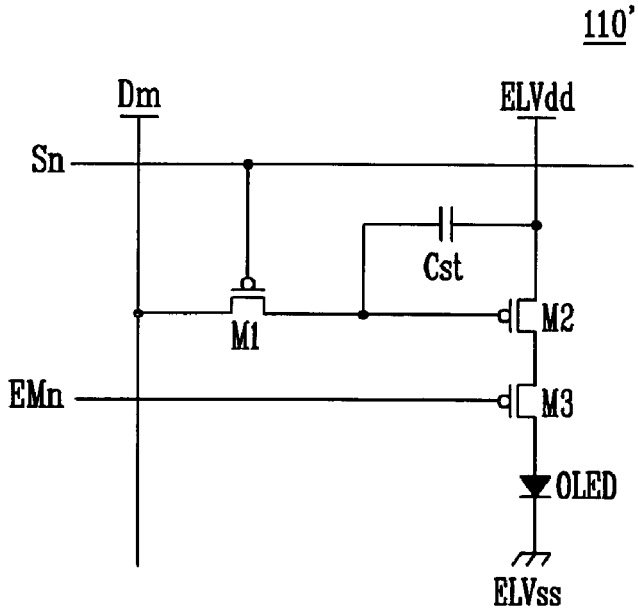
FIG. 10 illustrates another example of the pixel illustrated in FIG. 2.
Figure 11:
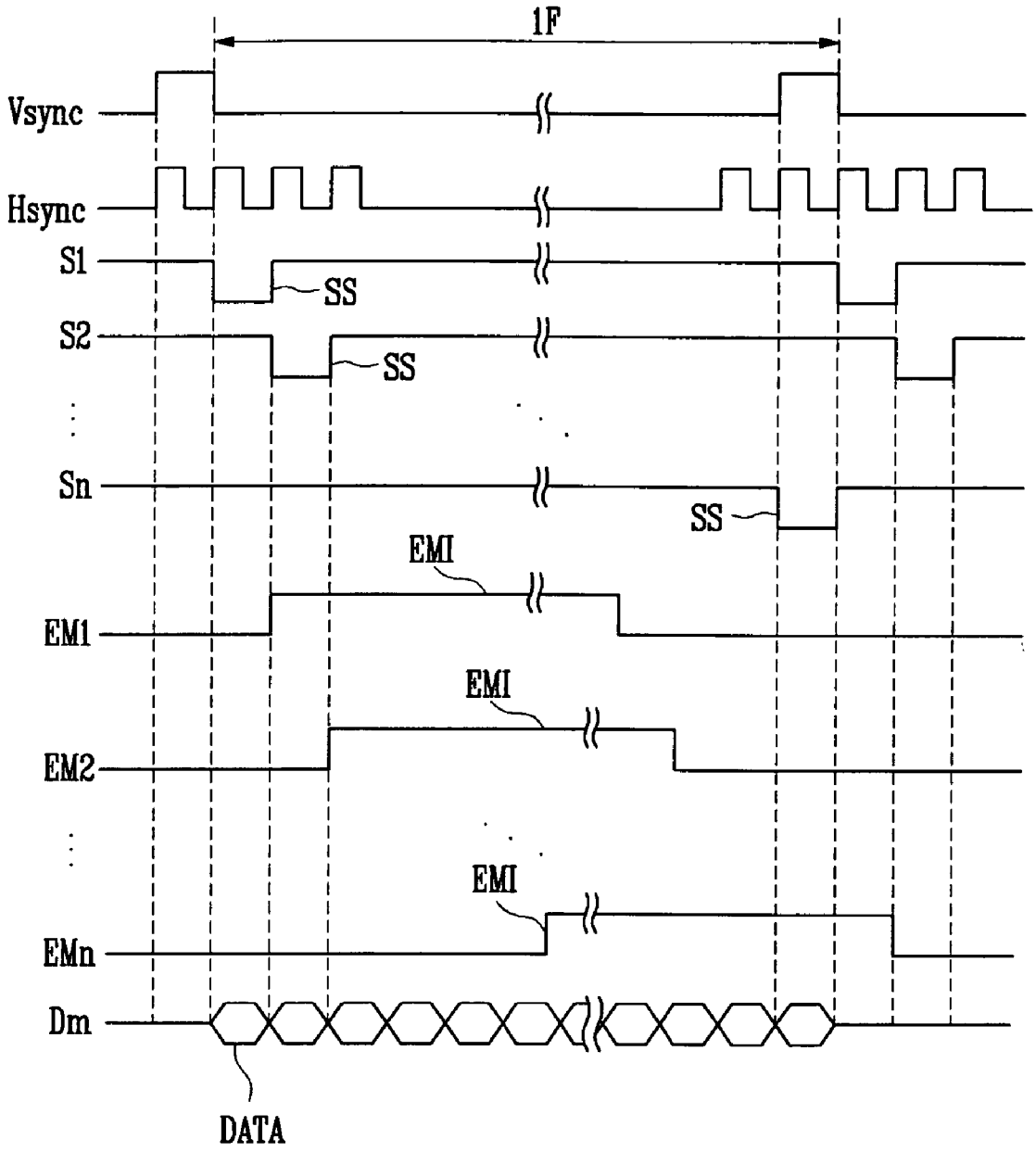
FIG. 11 illustrates waveforms that describe a method of driving the pixel illustrated in FIG. 10.

On the other hand, the pixel 110 of the organic light emitting display according to an alternative embodiment of the present invention may have the circuit 110' illustrated in FIG. 10. In the circuit of the alternative pixel 110' conduction type of the third transistor M3 that is turned on by the emission control signal EMl may be the same as the conduction type of the first and second transistors M1, M2. For example, the first, second, and third transistors M1, M2, M3 may be all PMOS. In this case, the operation processes illustrated in FIG. 11 are the same as the operation processes of the pixel 110 illustrated in FIGS. 3, 4A, and 4B excluding that the OLED emits light in the periods where the emission control signals EMl are not being applied. Therefore, a detailed description of the operation of this alternative pixel 110' is omitted.

According to the organic light emitting display of the present invention and the method of driving the same, it is possible to variably set the outside input modes in response to the requests of users and to change the brightness of the display region while saving memory. Also, when the brightness of the display region is limited, it is possible to reduce power consumption and to prevent the eyes of a user from getting tired. When the brightness is not being limited, it is possible to achieve a desirable contrast for the display region.

Although exemplary embodiments of the present invention have been shown and described, it would be appreciated by those skilled in the art that changes might be made in this embodiment without departing from the principles and spirit of the invention, the scope of which is defined in the claims and their equivalents.

What is claimed is:

1. An organic light emitting display comprising:

a data driver for supplying data signals corresponding to image data to a data line;

a scan driver for sequentially supplying scan signals to a scan line and sequentially supplying emission control signals to an emission control line;

a display region including a pixel adapted to receive the data signals, the scan signals, and the emission control signals; and a brightness controller for controlling a brightness of the display region, wherein the brightness controller comprises:

a first look up table for storing first widths of the emission control signals corresponding to the image data of one frame period; and a second look up table for storing change values for changing the first widths of the emission control signals responsive to outside input modes, wherein the scan driver is configured to receive the brightness control signals from the brightness controller and supply the emission control signals according to the received brightness control signals.

2. The organic light emitting display as claimed in claim 1, wherein the brightness controller further comprises:

a data summing unit for summing the image data of one frame period to generate sum data and for generating at least two digital values including uppermost bits of the sum data as control data;

a mode selector for extracting the change values corresponding to the outside input modes from the second look up table;

a controller for extracting the first widths corresponding to the control data from the first look up table and for generating second widths of the emission control signals using the first widths and the change values; and a brightness control signal generator for generating brightness control signals corresponding to the second widths and transmitting the brightness control signals to the scan driver.

3. The organic light emitting display as claimed in claim 2, wherein the scan driver controls widths of the emission control signals in response to the brightness control signals.

4. The organic light emitting display as claimed in claim 2, wherein the change values of widths of the emission control signals correspond to the outside input modes.

5. The organic light emitting display as claimed in claim 2, wherein the change values are selected as decimal values being fractions of one corresponding to the outside input modes.

6. The organic light emitting display as claimed in claim 5, wherein the controller generates the second widths by multiplying the first widths by the change values.

7. An organic light emitting display comprising:

a data driver for supplying data signals corresponding to image data to a data line;

a scan driver for sequentially supplying scan signals to a scan line and sequentially supplying emission control signals to an emission control line;

a display region including a pixel adapted to receive the data signals, the scan signals, and the emission control signals to display images; and a brightness controller for controlling a brightness of the display region, wherein the brightness controller comprises:

a first look up table for storing first widths of the emission control signals corresponding to the image data of one frame period; and a second look up table for storing change values for changing the first widths of the emission control signals responsive to outside input modes, wherein the brightness controller further comprises:

a data summing unit for summing the image data of one frame period to generate sum data and for generating at least two digital values including uppermost bits of the sum data as control data;

a mode selector for extracting the change values corresponding to the outside input modes from the second look up table;

a controller for extracting the first widths corresponding to the control data from the first look up table and for generating second widths of the emission control signals using the first widths and the change values; and a brightness control signal generator for generating brightness control signals corresponding to the second widths and transmitting the brightness control signals to the scan driver, wherein the brightness controller is configured to select the first widths so that the brightness of the display region is reduced as values of the control data increase.

8. The organic light emitting display as claimed in claim 7, wherein the brightness controller selects the first widths so that widths of the emission control signals are reduced as the values of the control data increase.

9. The organic light emitting display as claimed in claim 8, wherein, when the control data have at least one value including a minimum value of the control data, the first widths are selected so that the widths of the emission control signals are maintained uniform.

10. The organic light emitting display as claimed in claim 8, wherein, when the control data have at least one value including a maximum value of the control data, the first widths are selected so that the widths of the emission control signals are maintained uniform.

11. An organic light emitting display comprising:

a data driver for supplying data signals corresponding to image data to a data line;

a scan driver for sequentially supplying scan signals to a scan line and sequentially supplying emission control signals to an emission control line;

a display region including a pixel adapted to receive the data signals, the scan signals, and the emission control signals to display images; and a brightness controller for controlling a brightness of the display region, wherein the brightness controller comprises:

a first look up table for storing first widths of the emission control signals corresponding to the image data of one frame period; and a second look up table for storing change values for changing the first widths of the emission control signals responsive to outside input modes, wherein the brightness controller further comprises:

a data summing unit for summing the image data of one frame period to generate sum data and for generating at least two digital values including uppermost bits of the sum data as control data;

a mode selector for extracting the change values corresponding to the outside input modes from the second look up table;

a controller for extracting the first widths corresponding to the control data from the first look up table and for generating second widths of the emission control signals using the first widths and the change values; and a brightness control signal generator for generating brightness control signals corresponding to the second widths and transmitting the brightness control signals to the scan driver, wherein the second widths are generated by adding the first widths and the change values together or by subtracting the change values from the first widths.

12. An organic light emitting display comprising:

a data driver for supplying data signals corresponding to image data to a data line;

a scan driver for sequentially supplying scan signals to a scan line and sequentially supplying emission control signals to an emission control line;

a display region including a pixel adapted to receive the data signals, the scan signals, and the emission control signals to display images; and a brightness controller for controlling a brightness of the display region, wherein the brightness controller comprises:

a first look up table for storing first widths of the emission control signals corresponding to the image data of one frame period; and a second look up table for storing change values for changing the first widths of the emission control signals responsive to outside input modes, wherein the change values are selected so that the data on the first widths is not changed.

13. A method of driving an organic light emitting display, the method comprising:

extracting a first width of emission control signals using image data of one frame period;

extracting a change value in response to outside input modes and generating a second width using the first width and the change value;

generating brightness control signals having data on widths of emission control signals using the second width; and generating the emission control signals in response to the brightness control signals, wherein in the extracting a change value, the second width is generated by adding the change value to the first width or by subtracting the change value from the first width.

14. The method as claimed in claim 13, wherein the extracting a first width comprises:

summing image data of one frame period to generate sum data;

generating at least two digital values including uppermost bits of the sum data as control data; and extracting the first width corresponding to the control data.

15. The method as claimed in claim 14, wherein the first width is selected so that brightness of the display region is reduced as the control data increase.

16. The method as claimed in claim 15, wherein the first width is selected so that the widths of the emission control signals are reduced as the control data increase.

17. The method as claimed in claim 15, wherein the first width is selected so that the widths of the emission control signals are maintained uniform when the control data have at least one value including the minimum value.

18. The method as claimed in claim 15, wherein the first width is selected so that the widths of the emission control signals are maintained uniform when the control data have at least one value including the maximum value.

19. The method as claimed in claim 13, wherein the change value is selected so that the first width is not changed responsive to the outside input modes.

20. A method of driving an organic light emitting display, the method comprising:

extracting a first width of emission control signals using image data of one frame period;

extracting a change value in response to outside input modes and generating a second width using the first width and the change value;

generating brightness control signals having data on widths of emission control signals using the second width; and generating the emission control signals in response to the brightness control signals, wherein in the extracting of a change value, the second width is generated by multiplying the change value by the first width.

21. The method as claimed in claim 20, wherein the change value is selected so that the first width is not changed responsive to the outside input modes.

* * * * *